US005305738A

United States Patent [19]

Shimizu

[11] Patent Number: 5,305,738

[45] Date of Patent: Apr. 26, 1994

[54] MASSAGE DEVICE

[75] Inventor: Nobuzo Shimizu, Higashi-Osaka, Japan

[73] Assignee: Daito Electric Machine Industry Company Limited, Osaka, Japan

[21] Appl. No.: 886,942

[22] Filed: May 22, 1992

[51] Int. Cl.[5] ..... A61H 1/00

[52] U.S. Cl. ..... 601/35; 601/56; 601/135

[58] Field of Search ..... 128/32, 34–36, 128/44, 45, 46, 56, 59, 60, 61, 62 R

[56] References Cited

U.S. PATENT DOCUMENTS

| | | | |
|---|---|---|---|
| 807,299 | 12/1905 | Marshall | 128/46 |
| 1,006,684 | 10/1911 | Sands | 128/46 |
| 2,512,536 | 6/1950 | Zadek | 128/46 |
| 3,207,152 | 9/1965 | Thornton | 128/46 X |
| 3,945,076 | 3/1976 | Sung | 128/46 X |
| 3,993,052 | 11/1976 | Miyahara | 128/46 |
| 4,777,940 | 10/1988 | Yamasaki | 128/59 X |
| 4,777,945 | 10/1988 | Curtaz et al. | 128/60 X |
| 4,785,798 | 11/1988 | Yamasaki et al. | 128/59 X |
| 5,063,911 | 11/1991 | Teranishi | 128/56 X |
| 5,086,769 | 2/1992 | Vianello et al. | 128/56 X |
| 5,183,034 | 2/1993 | Yamasaki et al. | 128/36 |

FOREIGN PATENT DOCUMENTS

| | | |
|---|---|---|
| 44-12708 | 5/1969 | Japan . |
| 53-36275 | 10/1978 | Japan . |
| 63-51862 | 3/1988 | Japan . |

*Primary Examiner*—Danton D. DeMille
*Assistant Examiner*—Brian E. Hanlon
*Attorney, Agent, or Firm*—Birch, Stewart, Kolasch & Birch

[57] ABSTRACT

A massage device having kneading balls includes a vibrating device provided between each of the kneading balls and a connecting member for vibrating the ball. The connecting member is a spring, such as a coiled spring, which is elastically deformable in a direction perpendicular to its axis. The connecting member is attached to a rotary plate rotatable inside a housing, eccentrically with respect to the rotary plate and rotatable relative thereto. The housing is further provided therein with a rotation control device for preventing the connecting member from rotating about its own axis with the rotation of the rotary plate. This prevents the vibrating device on the connecting member and the kneading ball from rotating with the rotation of the rotary plate.

19 Claims, 7 Drawing Sheets

MASSAGE DEVICE

BACKGROUND OF THE INVENTION

1. Field of the Invention

The present invention relates to devices for massaging shoulders and other parts of the human body to relieve stiffness.

2. Description of Related Art

Such massage devices are divided generally into those of the kneading ball type and the vibrator type. Known massage devices of the former type comprise a pair of opposite rotary plates arranged in a housing and rotatable in directions opposite to each other, and kneading balls mounted on the respective rotary plates eccentrically with respect to the axis of rotation of the plate with a connecting member provided between the ball and the plate (see, for example, Examined Japanese Patent Publication SHO 53-36275). Massage devices of the latter type heretofore known comprise a contact member attached to one end of a tubular body which can be held by one hand, and an electric motor housed in the contact member and having an eccentric weight (see Unexamined Japanese Patent Publication SHO 63-51862 or Examined Japanese Utility Model Publication SHO 44-12708).

The conventional device of the kneading ball type has the function of slowly massaging stiff parts with a great pressure, while the known device of the vibrator type has the function of gently massaging stiff parts by giving a vibration of high frequency. However, the known devices are not adapted to perform both functions at the same time.

It appears possible to incorporate an electric motor having an eccentric weight into the massage device of the kneading ball type between the ball and the connecting member for the device to selectively perform a kneading action and/or a vibratory action.

Nevertheless, if the conventional massage devices of the different types are merely combined into such a device, a vibratory force is imparted to the kneading ball which is originally adapted to exert a high pressure, so that when the neck, leg or like body part is held between the kneading balls, an excessive pressure is likely to act on the part to adversely affect the part. Moreover, the vibration of the eccentric weight between the kneading ball and the connecting member is transmitted through the connecting member to the interior of the housing to cause damage to the electric circuit and rotary plate support mechanism within the housing.

OBJECTS AND SUMMARY OF THE INVENTION

In view of the above situation, a first object of the present invention is to provide a device which is adapted to massage stiff parts of the body suitably, comfortably and with safety in accordance with the condition of the body part and which itself has improved durability.

A second object of the invention is to provide a massage device wherein a vibrating motor is disposed between each kneading ball and a connecting member, the motor being prevented from rotating with the rotation of a rotary plate so as to ensure facilitated electric wiring for the motor.

To fulfill the above objects, the present invention provides the following technical means.

More specifically, the present invention provides a massage device which comprises:

a housing, a pair of rotary plates rotatably mounted respectively on a pair of opposite shafts disposed in the housing, means for drivingly rotating the pair of rotary plates in directions opposite to each other, a connecting member provided upright on each of the rotary plates eccentrically with respect to the shaft and made of a spring material so as to be elastically deformable in a direction perpendicular to its axis, a kneading ball attached to an upper end of the connecting member, and vibrating means provided between the kneading ball and the connecting member for vibrating the kneading ball.

The invention further provides a massage device which has the foregoing construction and in which the connecting member is attached to the rotary plate and rotatable relative thereto, and rotation control means is provided in the housing for preventing the connecting member from rotating about its own axis with the rotation of the rotary plate.

BRIEF DESCRIPTION OF THE DRAWINGS

The drawings show preferred embodiments of the invention.

DESCRIPTION OF THE PREFERRED EMBODIMENTS

Figure 1:
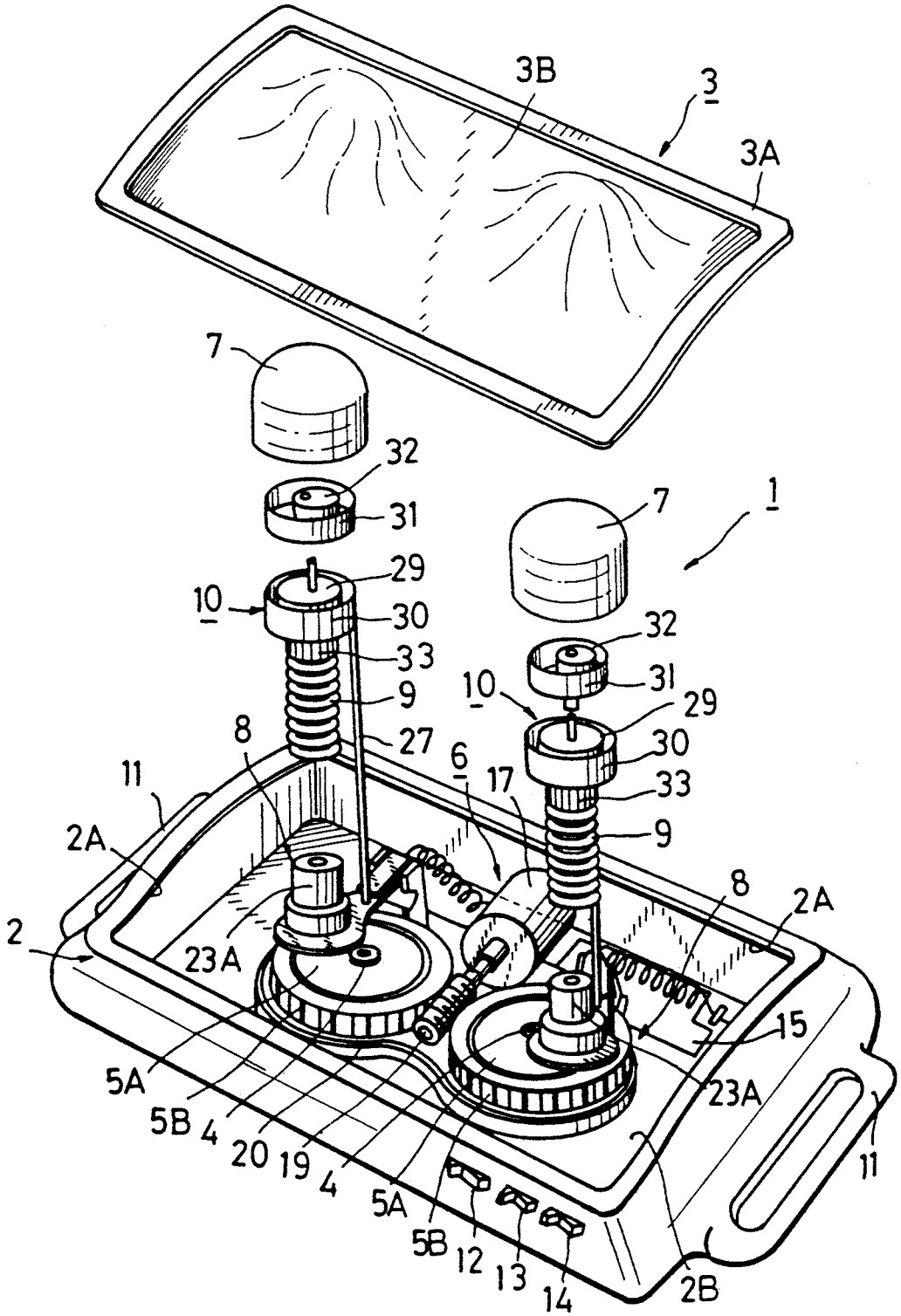
FIG. 1 is an exploded perspective view of a massage device as a first embodiment of the invention.
Figure 2:
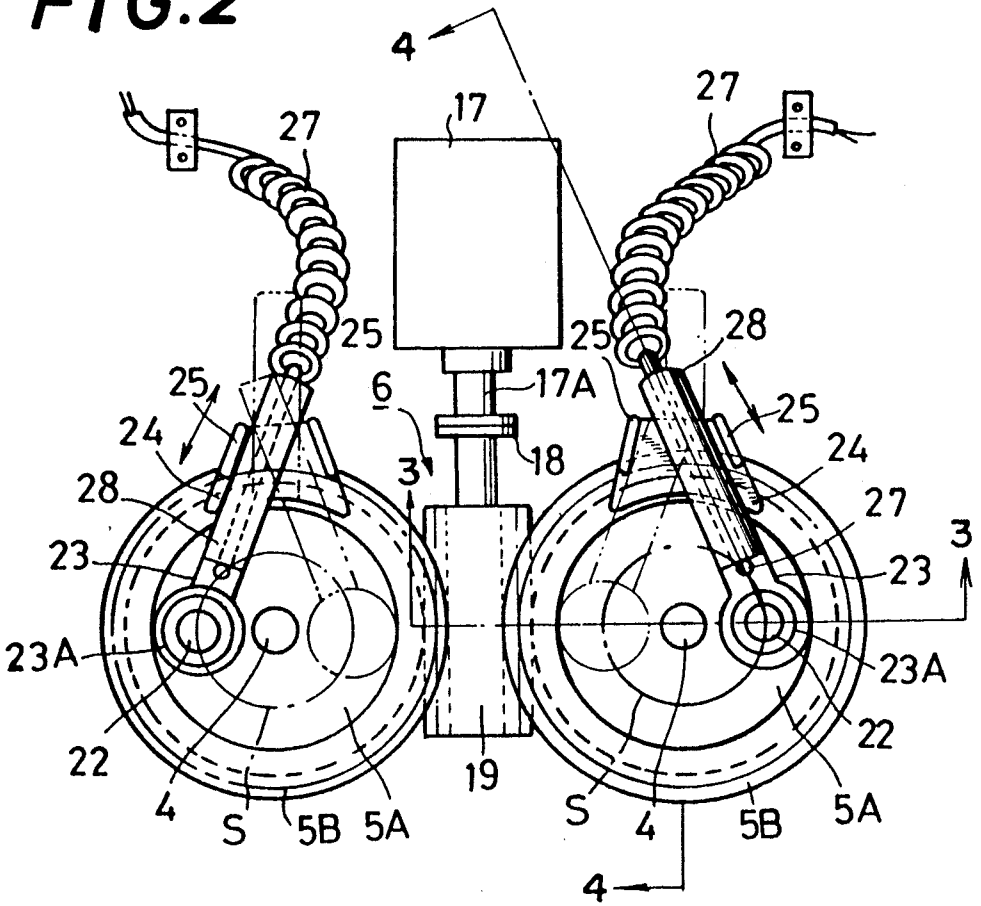
FIG. 2 is a fragmentary plan view of the device.
Figure 3:
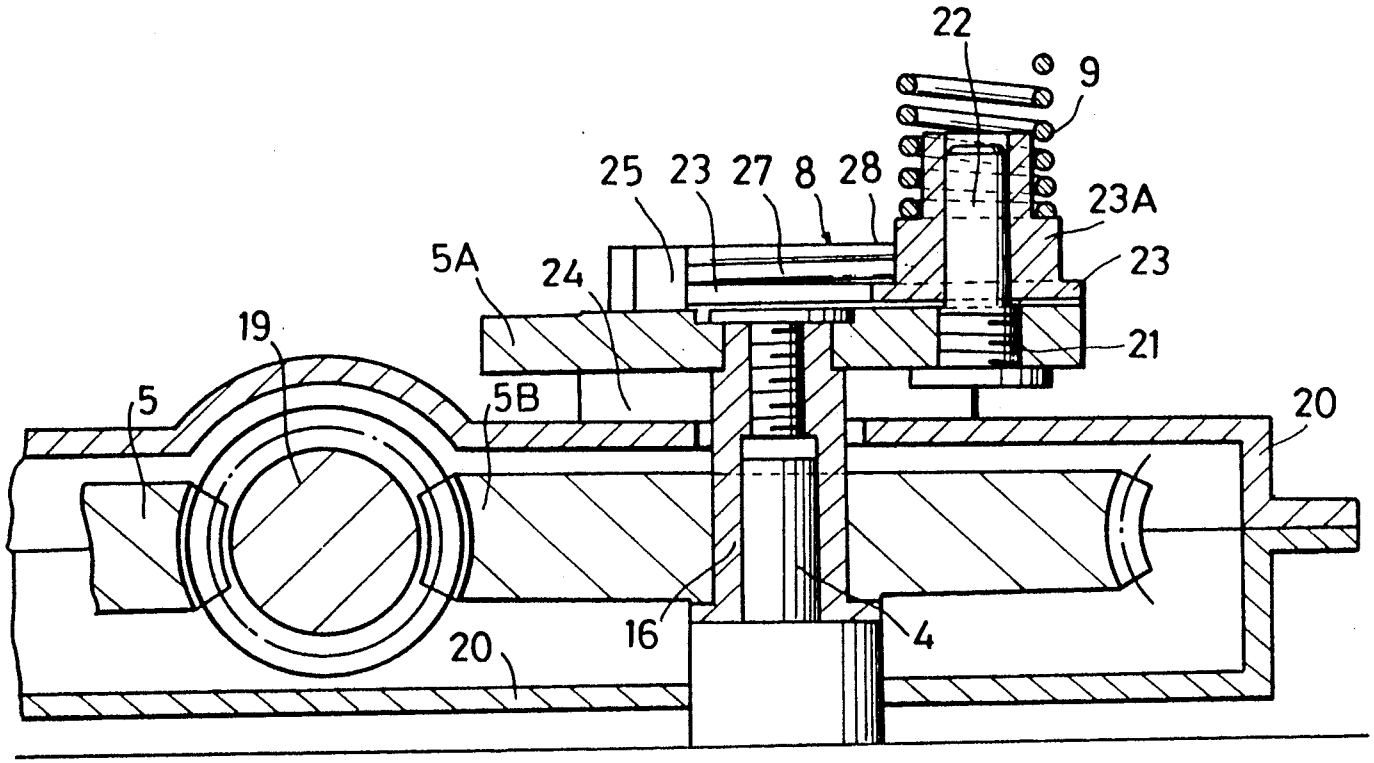
FIG. 3 is a view in section taken along the line 3—3 in FIG. 2.
Figure 4:
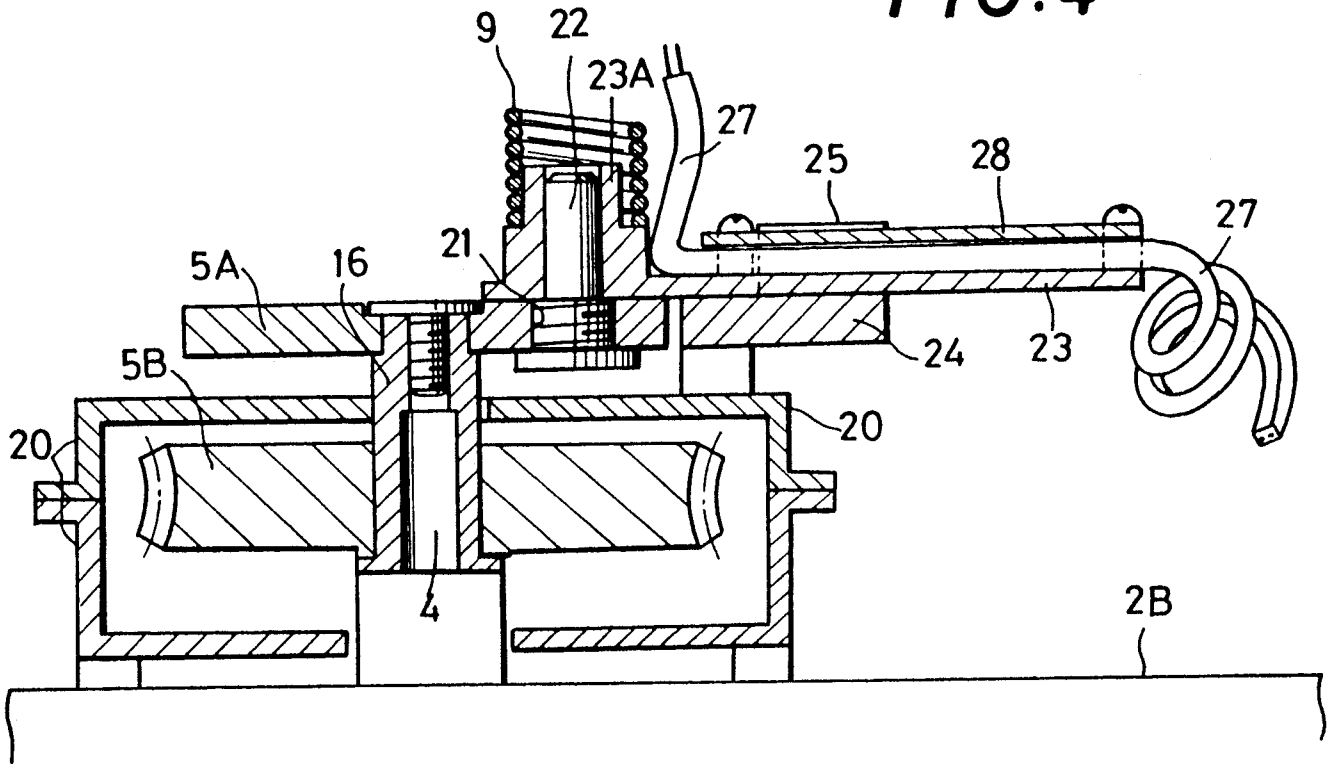
FIG. 4 is a view in section taken along the line 4—4 in FIG. 2.

The present invention will be described below in greater detail with reference to the illustrated embodiments.

FIGS. 1 to 4 show a first embodiment of the invention. The present embodiment, i.e., a massage device 1, comprises a housing 2 generally in the form of a rectangular box, a cover 3 fittable to an upper opening 2A of the housing 2, a pair of rotary plates 5A, 5A rotatably mounted respectively on a pair of opposite shafts 4, 4 which are arranged inside the housing 2 and extend upright from a bottom plate 2B thereof, and means 6 for drivingly rotating the rotary plates 5A in directions opposite to each other.

The massage device 1 further comprises connecting members 9, 9 each in the form of a coiled spring and provided on each of the rotary plates 5A, 5A eccentrically with respect to the shaft 4, a kneading ball 7 attached to the upper end of each connecting member 9, and vibrating means 10 provided between the kneading ball 7 and the connecting member 9. Also disposed inside the housing 2 is rotation control means 8 for preventing the connecting member 9 from rotating about its own axis with the rotation of the rotary plate 5A. The connecting member 9 can be any member insofar as the member is elastically deformable in a direction perpendicular to its axis. A plate spring is usable.

Handles 11, 11 are provided respectively on opposite lateral sides of the housing 2. Change-over switches 12, 13 and 14 are provided on the front side of the housing 2. A switchboard 15 is provided at one corner of the housing 2 inside thereof, such that the drivingly rotating means 6 and/or the vibrating means 10 can be operated by manipulating the change-over switches 12, 13 and 14.

The drivingly rotating means 6 comprises a primary motor 17 fixed to the bottom plate 2B of the housing 2, a worm 19 connected by a coupling 18 to the output shaft 17A of the motor 17, and worm wheels 5B, 5B arranged at opposite sides of the worm 19 and meshing therewith. Each of the worm wheels 5B is connected by a bush 16 to the rotary plate 5A coaxially therewith and is rotatable with the rotary plate 5A about the shaft 4 with the bush 16 fitted around the shaft 4. The worm wheels 5B, 5B and the worm 19 are enclosed with a protective cover 20 provided on the bottom plate 2B of the housing 2 and thereby made free from dust and the like.

The rotation control means 8 comprises a crankpin 22 screwed in a bore 21 which is formed eccentrically in the rotary plate 5A in parallel to the shaft 4, a pivotal lever 23 having one end fitted around the shank of the crankpin 22 rotatable relative thereto and the other end extending outward beyond the rotary plate 5A, and a guide member 24 fixed to the protective cover 20 and positioned outside the rotary plate 5A for limiting the range of pivotal movement of the other end of the pivotal lever 23. Projecting guide walls 25 are formed on the respective opposite sides of the guide member 24. The other end of the pivotal lever 23 extends between the guide walls 25.

The pivotal lever 23 is formed at the above-mentioned one end with a slide sleeve 23A fitting around the crankpin 22. The connecting member 9 has a lower end fitting around and connected to the slide sleeve 23A.

When the rotary plate 5A rotates, therefore, the aforementioned one end of the pivotal lever 23 revolves on a circular path S centered about the shaft 4, whereas the range of pivotal movement of the other lever end is limited. This prevents the slide sleeve 23A of the pivotal lever 23 from rotating about its own axis with the rotation of the rotary plate 5A, whereby the connecting member 9 joined to the slide sleeve 23A, and the kneading ball 7 and the vibrating means 10 mounted on the member 9 are also precluded from rotating about their respective axes with rotation of the rotary plate 5A.

The kneading ball 7 is hollow in its interior and has at its lower end an opening in which the vibrating means 10 is provided. The vibrating means 10 comprises a motor case 30 fixed by a mount portion 33 to the upper end of the connecting member 9, a secondary motor 29 having an upward drive shaft fixedly provided in the motor case 29, and a vibrating weight 32 mounted on the drive shaft of the motor 29 eccentrically with respect to the shaft. The vibrating weight 32 is covered with a case 31 having a bottom.

A holding plate 28 is fastened to the pivotal lever 23 with screws. An electric cord 27 for the secondary motor 29 is held between the holding plate 28 and the lever 23 and is thereby made to extend along the length of the lever 23.

The cover 3 comprises a rectangular frame 3A and a fabric 3B extending over the frame and is removably attached to the open upper side 2A of the housing 2.

When both the primary motor 17 and the secondary motors 29 of the present embodiment thus constructed are initiated into operation, the rotary plates 5A are rotated clockwise or counterclockwise in directions opposite to each other, causing the kneading balls 7 to perform a kneading motion, and the vibrating weights 32 rotate to vibrate the kneading balls 7. According to the present embodiment, each vibrating means 10 is connected to the rotary plate 5A by the connecting member 9 comprising a coiled spring, so that even when the neck or leg is held between the pair of kneading balls 7, the connecting members 9 elastically deform to attenuate the pressure of the balls 7. The device therefore massages the stiff part with safety and without causing any pain thereto. When the device is used with the neck or leg held between the kneading balls 7, the elastic deformation of the connecting members 9 rather coats with the vibration of the balls 7 imparted thereto by the vibrating means 10 to produce a suitable massaging effect on the stiff part.

Furthermore, the connecting member 9 acts to suppress transmission of the vibration produced by the vibrating means 10 to the rotary plate 5A, thereby protecting the electric circuit and the rotary plate support mechanism inside the housing 2 from damage.

With the present embodiment, the rotation control means 8 prevents the connecting member 9 and the secondary motor 29 thereon from rotating about their own axes with the rotation of the rotary plate 5A, with the result that the electric cord 27, even if connected directly to the secondary motor 29, is unlikely to wind around the connecting member 9. This ensures facilitated electric wiring inside the housing 2.

Figure 5:
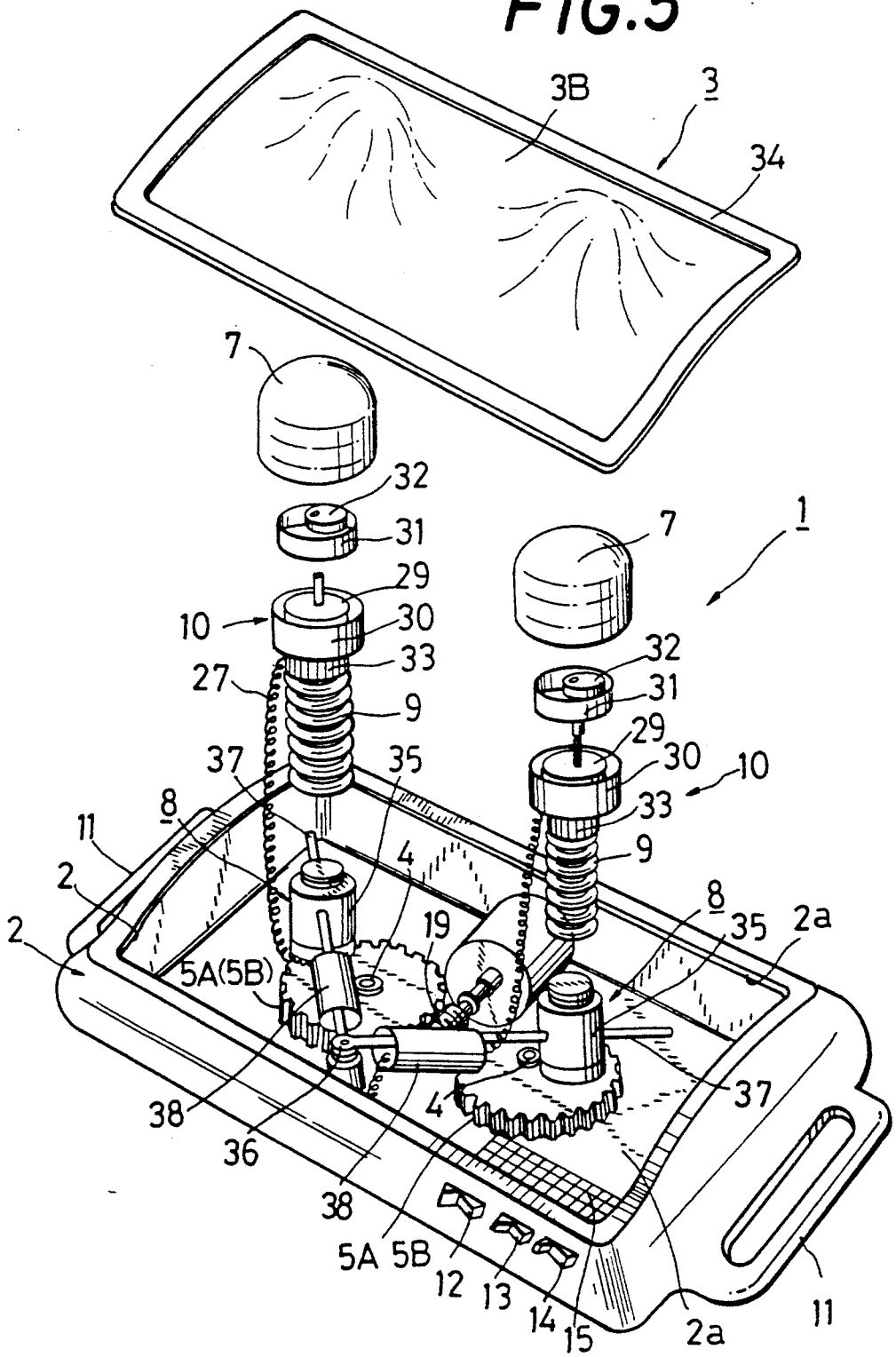
FIG. 5 is an exploded perspective view of another massage device as a second embodiment of the invention.
Figure 6:
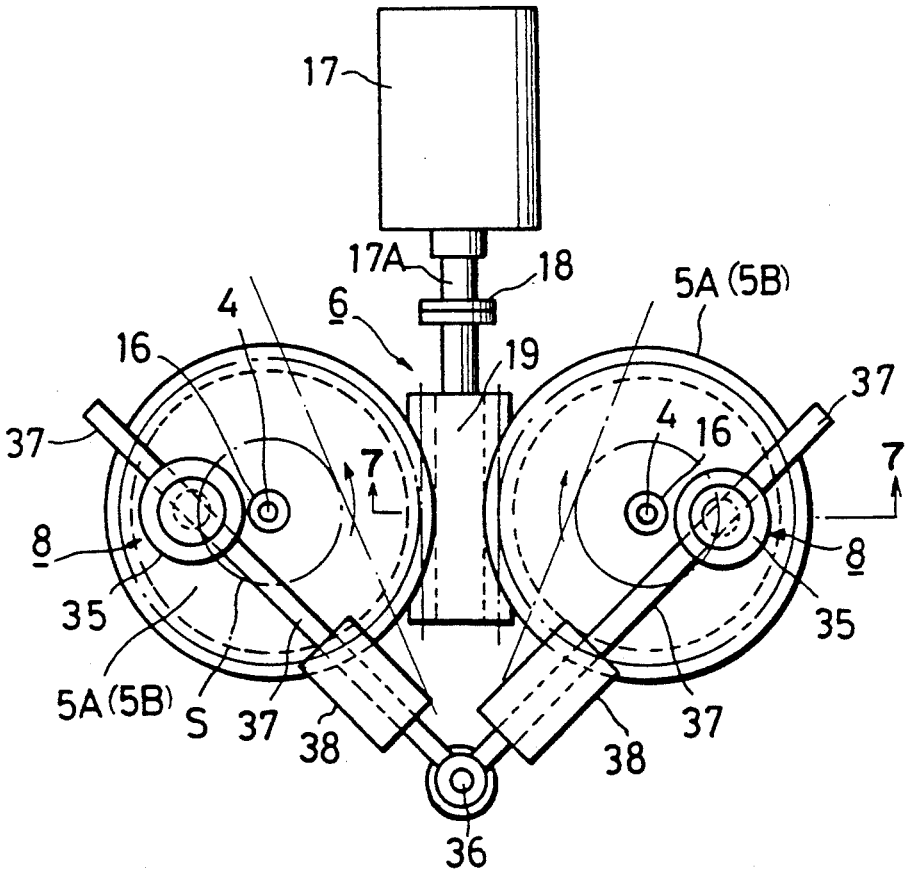
FIG. 6 is a fragmentary plan view of the device.
Figure 7:
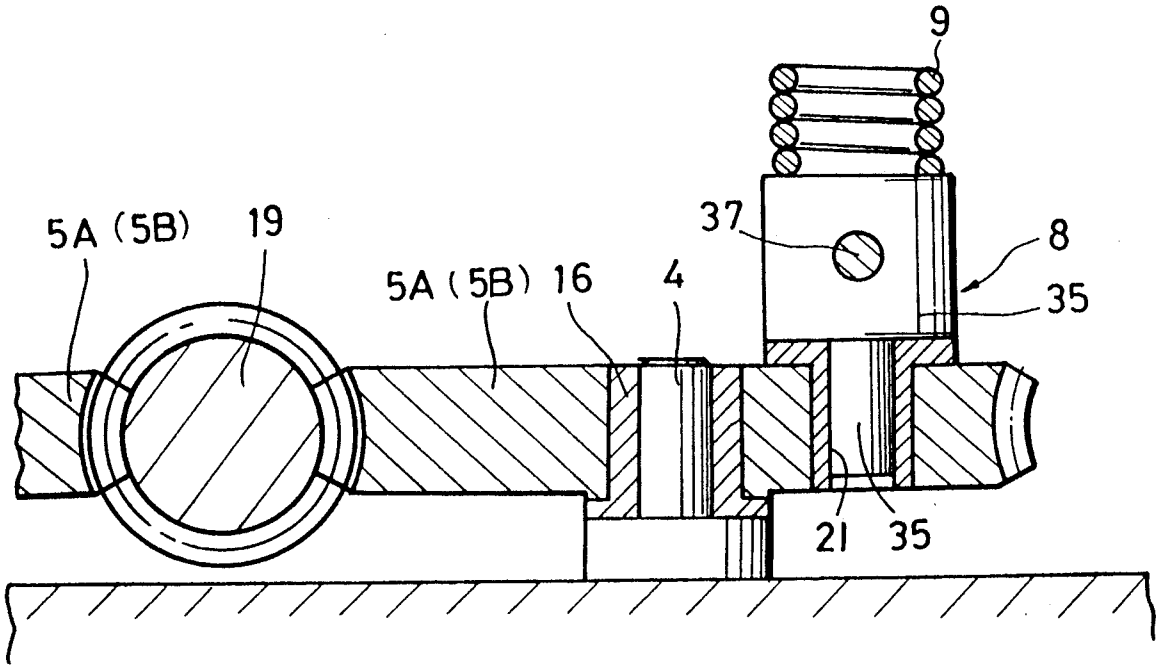
FIG. 7 is a view in section taken along the line 7—7 in FIG. 6.

FIGS. 5 to 7 show a second embodiment of the invention. The second embodiment differs from the first embodiment in the construction of rotation control means 8. Accordingly, like parts are designated by like reference numerals throughout the drawings and will not be described repeatedly. The different feature only will be described below.

The rotation control means 8 of the second embodiment comprises a support pin 35 mounted on each rotary plate 5A and positioned eccentrically with respect to the shaft 5, and a pivotal rod 37 having one end slidably extending through the support pin 35 diametrically thereof and the other end pivotably supported by a fulcrum pin 36 disposed outside the rotary plate 5A. The connecting member 9 has a lower end connected to the support pin 35.

Even when the rotary plate 5A rotates, therefore, the support pin 35, which has the pivotal rod 37 extending therethrough, will not rotate with the rotary plate 5A. This prevents the connecting member 9 on the pin 35 and the vibrating means 10 on the member 9 from rotating about their own axes with the rotation of the rotary plate 5A.

The rotary plate 5A of the present embodiment serves also as a worm wheel 5B. The embodiment therefore comprises a reduced number of components.

The pivotal rod 37 has a protective tube 38 fitted around an intermediate portion thereof. The electric cord 27 for the secondary motor 29 is inserted through the protective tube 38.

What is claimed is:

1. A massage device comprising:

a housing;

a pair of rotary plates rotatably mounted respectively on a pair of opposite shafts disposed in the housing with one plate for each shaft;

means for drivingly rotating the pair of rotary plates in directions opposite to each other;

a connecting member provided upright on and rotatable relative to each of the rotary plates with an axis of the connecting member being eccentric relative to each of the opposite shafts;

a kneading ball attached to an upper end of each of the connecting members;

vibrating means provided between each of the kneading balls and the connecting members for vibrating the kneading balls; and rotation control means for causing each connecting member to always direct the housing in a substantially constant direction when the connecting member revolves about the shaft by the rotation of the rotary plate about the opposite shafts.

2. The massage device as defined in claim 1, wherein the rotation control means comprises pivotal levers, each having one end pivotally connected to one of said pair of rotary plates and eccentrically placed with respect to each of the opposite shafts and the other end extending outward beyond said one of said pair of rotary plates, and a guide member fixedly provided outside said one of said pair of rotary plates for limiting the range of pivotal movement of the other end of the pivotal lever, each connecting member having a lower end connected to said one end of the pivotal levers, respectively.

3. The massage device as defined in claim 1, wherein the rotation control means comprises support pins, each mounted on one of said pair of rotary plates and eccentrically placed with respect to the pair of opposite shafts, and pivotal rods, each having one end extending through the support pins, respectively and slidably diametrically thereof and the other end pivotably supported by a fulcrum pin provided outside of said one of said pair of rotary plates, each the connecting member having a lower end connected to the support pins, respectively.

4. The massage device as defined in claim 1 wherein the connecting member comprises a coiled spring.

5. The massage device as defined in claim 4, wherein said means for drivingly rotating comprises a primary motor fixedly provided in the housing and having a drive shaft carrying a worm, and a pair of worm wheels arranged on opposite sides of the worm and meshing therewith, the worm wheels being connected to the respective rotary plates coaxially therewith.

6. The massage device as defined in claim 5, wherein the vibrating means comprises a secondary motor fixed to the upper end of the connecting member, and a vibrating weight attached to a drive shaft of the secondary motor.

7. The massage device as defined in claim 7, wherein the rotation control means comprises pivotal levers, each having one end pivotally connected to one of said pair of rotary plates and eccentrically placed with respect to the pair of opposite shafts and the other end extending outward beyond said one of said pair of rotary plates, and a guide member fixedly provided outside of said one of said pair of rotary plates for limiting the range of pivotal movement of the other end of the pivotal lever, each connecting member having a lower end connected to said one end of the pivotal levers, respectively.

8. The massage device as defined in claim 7, wherein an electric cord connected to the secondary motor is attached to the pivotal lever and extends along the length thereof.

9. The massage device as defined in claim 6, wherein the rotation control means comprises support pins, each mounted on one of said pair of rotary plates and eccentrically placed with respect to the pair of opposite shafts, and pivotal rods, each having one end extending through the support pins, respectively and slidably diametrically thereof and the other end pivotably supported by a fulcrum pin provided outside said one of said pair of rotary plates, each connecting member having a lower end connected to the support pins, respectively.

10. A massage device as defined in claim 9, wherein an electric cord connected to the secondary motor is attached to the pivotal lever and extends along the length thereof.

11. A massage device comprising:

a housing;

a pair of rotary plates with one plate each mounted on one shaft, respectively, of a pair of opposite shafts disposed in the housing;

means for drivingly rotating each one of said pair of rotary plates in directions opposite to each other;

a connecting member provided upright on and rotatable relative to each of the rotary plates and eccentric relative to each of the pair of opposite shafts, said connecting member being elastically deformable in a direction perpendicular to its axis, wherein the connecting member is attached to the rotary plate and rotatable relative thereto; and a kneading ball attached to an upper end of each of the connecting members;

vibrating means provided between each of the kneading balls and the connecting members for vibrating the kneading balls;

rotation control means provided in the housing for preventing said connecting member from rotating about its own axis with the rotation of the rotary plate, said rotation control means including pivotal levers, each having one end pivotally connected to one of said pair of rotary plates and eccentrically placed with respect to each of the opposite shafts and the other end extending outward beyond said one of said pair of rotary plates, and a guide member fixedly provided outside of said one of said pair of rotary plates for limiting the range of pivotal movement of the other end of the pivotal lever, each connecting member having a lower end connected to said one end of the pivotal levers, respectively.

12. A massage device comprising:

a housing; a pair of rotary plates with one plate each mounted on one shaft, respectively, of a pair of opposite shafts disposed in the housing; means for drivingly rotating each one of said pair of rotary plates in directions opposite to each other; a connecting member provided upright on and rotatable relative to each of the rotary plates and eccentric relative to each of the pair of opposite shafts, said connecting member being elastically deformable in a direction perpendicular to its axis, wherein the connecting member is attached to the rotary plate and rotatable relative thereto; a kneading ball attached to an upper end of each of the connecting members; vibrating means provided between each of the kneading balls and the connecting members for vibrating the kneading balls; and rotation control means comprises support pins, each mounted on one of said pair of rotary plates and eccentrically placed with respect to the pair of opposite shafts, and rods, each pivotal and having one end extending through the support pins, respectively and slidably diametrically thereof and the other end pivotably supported by a fulcrum pin provided outside of said one of said pair of rotary plates, each, the connecting member having a lower end connected to the support sins, respectively.

13. The massage device as defined in claim 11, wherein the connecting member comprises a coiled spring.

14. The massage device as defined in claim 12, wherein said means for drivingly rotating comprises a primary motor fixedly provided in the housing and having a drive shaft carrying a worm, and a pair of worm wheels arranged on opposite sides of the worm and meshing therewith, the worm wheels being connected to the respective rotary plates coaxially therewith.

15. The massage device as defined in claim 14, wherein the vibrating means comprises a secondary motor fixed to the upper end of the connecting member, and a vibrating weight attached to a drive shaft of the secondary motor.

16. The massage device as defined in claim 15, wherein the rotation control means comprises pivotal levers, each having one end pivotally connected to one of said pair of rotary plates and eccentrically placed with respect to the pair of opposite shafts and the other end extending outward beyond said one of said pair of rotary plates, and a guide member fixedly provided outside of said one of said pair of rotary plates for limiting the range of pivotal movement of the other end of the pivotal lever, each connecting member having a lower end connected to said one end of the pivotal levers, respectively.

17. The massage device as defined in claim 16, wherein an electric cord connected to the secondary motor is attached to the pivotal lever and extends along the length thereof.

18. The massage device as defined in claim 15, wherein the rotation control means comprises support pins, each mounted on one of said pair of rotary plates and eccentrically placed with respect to the pair of opposite shafts, and rods, each having one end extending through the support pins, respectively and slidably diametrically thereof and the other end pivotably supported by a fulcrum pin provided outside the rotary shaft, the connecting member having a lower end connected to the support pins, respectively.

19. The massage device as defined in claim 18, wherein an electric cord connected to the secondary motor is attached to the pivotal lever and extends along the length thereof.

* * * * *